United States Patent [19]

Willoughby et al.

[11] Patent Number: 4,880,064

[45] Date of Patent: Nov. 14, 1989

[54] TORQUE SENSING, AUTOMATIC SHUT-OFF AND RESET CLUTCH FOR SCREWDRIVERS, NUTSETTERS AND THE LIKE

[75] Inventors: Robert Willoughby, Washington; Phil D. Thorp, Bryan, both of Ohio

[73] Assignee: The Aro Corporation, Bryan, Ohio

[21] Appl. No.: 117,156

[22] Filed: Nov. 5, 1987

[51] Int. Cl.[4] ..... B25B 23/145

[52] U.S. Cl. ..... 173/12; 81/470; 192/150

[58] Field of Search ..... 173/12, 104, 163; 192/150; 81/470, 469, 467

[56] References Cited

U.S. PATENT DOCUMENTS

| | | | |
|---|---|---|---|
| 2,732,746 | 1/1956 | Livermont | 81/52.4 |
| 2,984,133 | 5/1961 | Livermont | 81/52.4 |
| 3,020,789 | 2/1962 | Etzkorn | 81/52.4 |
| 3,034,623 | 5/1962 | Amtsberg | 192/56 |
| 3,174,599 | 3/1965 | Spsyridakis et al. | 192/56 |
| 3,187,865 | 6/1965 | Blachowski | 192/56 |
| 3,194,370 | 7/1965 | Bennett | 192/56 |
| 3,220,526 | 1/1965 | Gattiker, Jr. | 192/150 |
| 3,262,536 | 7/1966 | Frisbie et al. | 192/150 |
| 3,498,389 | 3/1970 | Tibbott | 173/12 |
| 3,515,251 | 6/1970 | Clapp | 192/150 |
| 3,993,145 | 11/1976 | Findeli | 173/12 |
| 4,071,092 | 1/1978 | Wallace | 173/12 |
| 4,078,618 | 3/1978 | DePagter et al. | 173/12 |
| 4,258,798 | 3/1981 | Campbell et al. | 173/168 |
| 4,480,699 | 11/1984 | Elmer | 173/12 |
| 4,576,270 | 3/1986 | Baltz et al. | 173/12 X |
| 4,631,992 | 12/1986 | Eckman | 81/470 |

*Primary Examiner*—Frank T. Yost
*Assistant Examiner*—James L. Wolfe
*Attorney, Agent, or Firm*—Allegretti & Witcoff, Ltd.

[57] ABSTRACT

An improved torque control and fluid shut-off mechanism for a fluid operated tool includes a bit holder and driving clutch member which are connected for uniform cojoint axial movement and independent rotary movement. Spring biased ball bearings provides for cojoint rotary movement which is overcome when the spring biasing force associated with the driving clutch member exceeds a threshold level. A locking sleeve fitted over the driving clutch member cooperates with a control rod for the fluid inlet to the rotary vane air motor to control initiation of operation, termination of operation, and resetting of the tool.

6 Claims, 1 Drawing Sheet

TORQUE SENSING, AUTOMATIC SHUT-OFF AND RESET CLUTCH FOR SCREWDRIVERS, NUTSETTERS AND THE LIKE

BACKGROUND OF THE INVENTION

This invention relates to an improved torque control, fluid shut-off, and reset mechanism for a fluid operated tool.

Fluid operated tools for driving fasteners and the like typically incorporate a rotary vane air motor to drive a rotary output shaft. Such tools are often equipped with a clutch mechanism responsive to the torque imparted by the tool onto the fastener. When a specific torque is reached, the clutch mechanism automatically slips and terminates further tool output to the fastener.

Starting the tool is often effected by positioning a bit or bit holder against the fastener and axially translating the bit holder by pushing it against the fastener. Such axial translation opens a fluid valve to the tool.

To combine start up control, torque control as well as a shut-off in a single mechanism is a desirable goal, and many tools include torque responsive shut-off mechanisms coupled with mechanisms for initiating operation of the tool. It is also desirable to have all of the operations of starting of the tool, torque control and shut-off as well as resetting associated merely with the activity of placing the tool against the fastener or removing the tool from the fastener.

There are many prior art references which disclose devices of this general nature. Of particular pertinence is U.S. Pat. No. 4,576,270 issued Mar. 18, 1986 for a torque control and fluid shutoff mechanism for a fluid operated tool. That patent and the references cited therein are incorporated herewith by reference.

U.S. Pat. No. 4,576,270 teaches the use of a bit which is axially translatable in order to open the inlet valve to the tool for operation of a rotary vane air motor. A clutch mechanism in the tool comprises opposed, interlocking jaws which are associated with a bit holder and shaft respectively. Upon reaching a threshold torque, the jaws separate by rotating relative to one another and cause the inlet valve to close and terminate fluid flow to the rotary vane air motor.

While the apparatus disclosed in the aforesaid patent is quite useful and successful, an improved mechanism having a simple construction and also having a reset capability associated with removal of the tool from the fastener has been sought. These are among the features and advantages sought which inspired the development of the present invention.

SUMMARY OF THE INVENTION

Briefly the present invention relates to a fluid powered, rotary output tool that is useful as a screwdriver, nutrunner or the like. The tool includes a housing which encloses a fluid driven motor. The motor, either directly or through a transmission, drives a rotary output shaft. The shaft defines a center line axis for the tool. A fluid inlet to the motor directs pressurized fluid to operate the motor. A valve member is cooperative with the fluid inlet to control fluid flow to the motor.

A bit holder for a tool bit at the forward end of the tool is aligned axially with the motor output shaft. A clutch mechanism positioned intermediate the bit holder and the output shaft serves to connect that shaft with the bit holder. Thus, the motor output shaft, the bit holder and the clutch mechanism are substantially coaxial.

The invention specifically relates to an improvement in such a tool of a torque responsive, fluid flow start, shut-off and reset mechanism incorporated in combination with the clutch mechanism and bit holder. The bit holder is thus supported in the housing for axial as well as rotary movement. The bit holder corresponds to a driven member of the clutch mechanism and include an annular shaped flange coaxial with the axis and defining a planar surface transverse to the axis. The flange includes a series of pockets equally radially spaced from the axis in the surface of the flange.

A driving clutch member is coupled to the bit holder for axial movement therewith. The clutch member is also drivingly coupled at its opposite end to the output shaft of the motor and/or a gearing train intermediate the motor and the clutch member.

The clutch member connection to the bit holder is designed to permit rotation of the clutch member with respect to the bit holder under certain torque threshold conditions. Thus, the clutch member includes a series of spring biased roller members which are retained by the clutch member and normally engage the pockets associated with the bit holder. During normal operation, rotary output of the driving clutch member is imparted to the bit holder and thus the bit as well as the fastener due to the described engagement of the roller members in the bit holder pockets. When a torque threshold is reached, however, the roller members slide out of the pockets thereby disengaging the driving clutch member from the bit holder. This simultaneously causes closing of the valve member at the fluid inlet to the rotary motor.

The specific mechanism for terminating fluid flow to the motor includes a motor inlet valve control rod positioned within a counterbore in the driving clutch member. The motor inlet valve control rod is biased into the counterbore and causes the control rod to engage or be cammed against a radially displaceable bearing that slides in a passage extending radially from the counterbore. The bearing cooperates with a sleeve slidable on the outside of the driving clutch member. The sleeve is designed to maintain the displaceable bearing in one of two positions: (1) a radial outward position associated with release of the control rod and closing of the motor inlet valve, and (2) a radial inward position associated with camming engagement of the control rod for maintenance of the motor inlet valve in an open condition.

The mechanism thus combines a number of features in a unique fashion, utilizing fewer parts, the parts all being interrelated to control not only air flow to the motor but the torque output associated with the motor while at the same time permitting initiation of operation of the motor, termination of operation of the motor once a torque threshold has been reached and resetting of the torque control once the tool has been removed from engagement with a fastener.

Thus, it is an object of the invention to provide an improved torque responsive, fluid powered tool which terminates torque driving output from the tool upon reaching a torque threshold level.

Another object of the invention is to provide an improved torque responsive, fluid powered tool wherein the tool bit is translated axially in order to initiate operation of the tool by opening the fluid control valve to the air motor for the tool.

It is a further object of the invention to provide an improved torque responsive, fluid powered tool wherein sensing of the torque threshold is effected by cooperative interaction between a bit holder and a driving clutch member interconnected by means of a biased roller member.

Yet another object of the invention is to provide an improved torque responsive, fluid powered tool wherein sensing of torque threshold by a cooperative driving member and bit holder or driven member also acts to release a fluid inlet control valve thereby shutting off fluid supply to the motor.

A further object of the invention is to provide a torque responsive, fluid powered tool which automatically terminates operation of the powered tool upon reaching a threshold level of torque and which is resetable upon termination of fluid supply to the motor of the tool followed by mechanical release of the tool from the fastener upon which the tool has been operating.

Yet another object of the invention is to provide an improved torque responsive, fluid powered tool having a simplified construction, a minimum number of parts which is rugged, easy to repair, and easy to use.

Another object of the invention is to provide a fluid powered tool having an adjustable torque threshold level independent of motor and gearing output.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
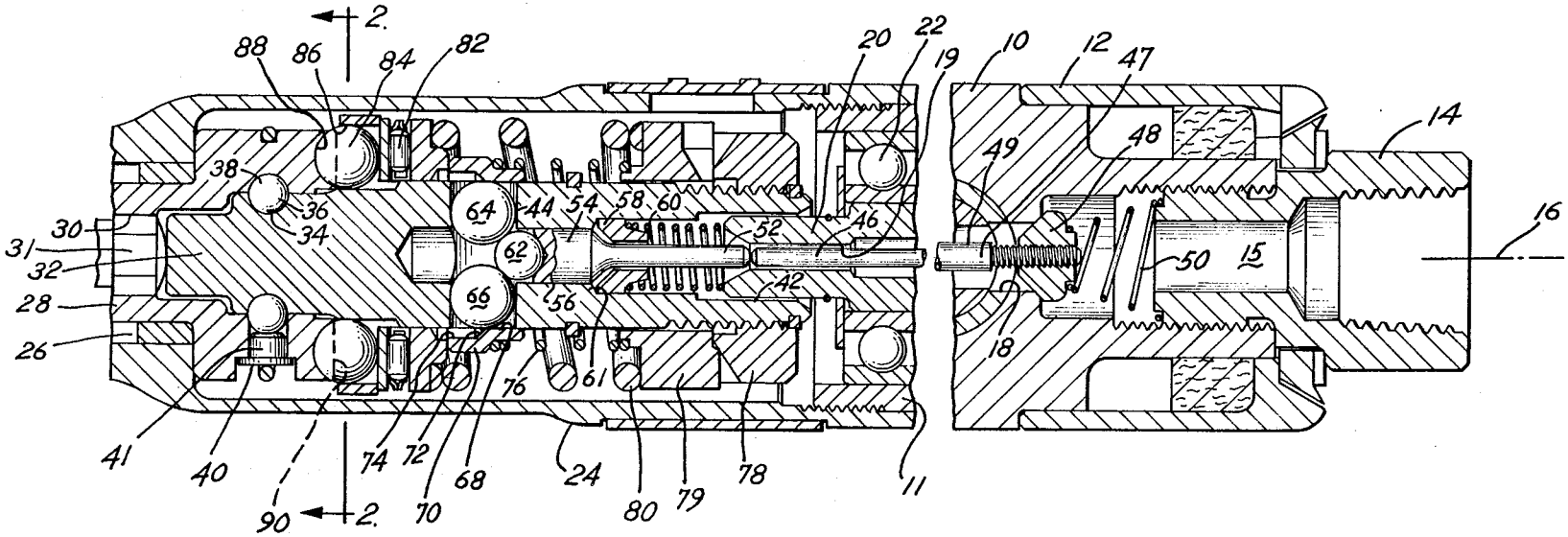
FIG. 1 is a longitudinal cross sectional view of a rotary vane, air motor driven, fastening tool along its longitudinal axis.
Figure 2:
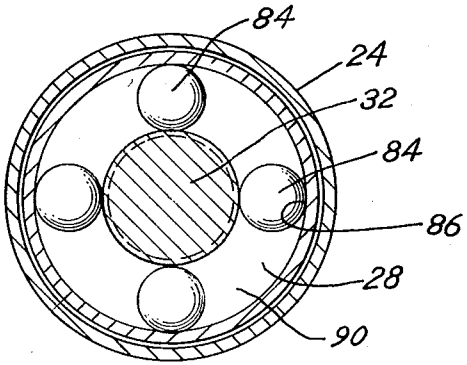
FIG. 2 is a transverse cross sectional view of the tool of FIG. 1 taken substantially along the line 2—2.

FIG. 1 is a partial cross sectional view of a pneumatic screwdriver which incorporates the improved torque control, start-up, shut-off, and reset mechanism of the present invention. The screwdriver includes main body 10 with a rear housing 12 affixed to the main body 10. A fluid flow inlet fitting 14 is threadably attached to the rear housing 12 and defines a fluid flow inlet 15 to the tool. The tool has an elongated center line axis 16 which runs the length thereof and about which the component parts are generally symmetrical. The center line axis 16 is the axis of rotation of a rotary vane fluid driven motor (not shown) within the tool, the output shaft 20 for that motor, and a bit holder 28 and bit 31 associated with the tool. Note that output shaft 20 may be a shaft directly extending from the rotor of the air motor or it may be an output shaft from a transmission driven by the air motor.

A central passage 18 extends from the fitting 14 through the body 10 to the air motor. Bore 18 in body 10 connects with the fluid driven, rotary vane air motor (not shown) within the body 10 to provide a fluid flow path to operate the motor. The output shaft 20 (whether directly from the motor or from an intermediate transmission) is mounted in bearings 22 supported by a sleeve 11 retained in body 10 whereby the output shaft 20 may be driven about the axis 16 within the body 10.

A forward housing 24 is attached to the body 10. Forward housing 24 extends from the body 10 forward to support bit holder bearings 26. Bearings 26 support the bit holder 28 permitting that bit holder 28 to rotate about the axis 16 on the bearings 26 as well as move axially with respect to the axis 16 on bearings 26. Bit holder 28 includes a forward keyed passage 30 for receipt of the bit 31 for driving a fastener, for example.

Intermediate the bit holder 28 and the output shaft 20 of the air motor (not shown) is the clutch mechanism, reset assembly and torque control mechanism of the invention. This mechanism includes a driving clutch member 32 which is keyed at one end to the shaft 20 and rotational at its opposite end with respect to the bit holder 28. The clutch member 32 thus includes a circumferential groove 34 into which ball bearings 36 are positioned to cooperate with a complementary locking groove 38 in the bit holder 28. The bearings 36 are retained in position by a pin 41 spring clip 40. In this manner the clutch member 32 may rotate with respect to the bit holder 28. However, the clutch member 32 and bit holder 28 move cojointly in the axial direction, for example, in response to axial force imparted to a bit 31 which is projected into the keyed bit opening 30 and engaging the forward end of the clutch member 32.

At the opposite end of the clutch member 32, a counterbore 42 receives the drive shaft 20. The drive shaft 20 is keyed to the counterbore 42. The counterbore 42 extends axially forward from the drive shaft 20 to a transverse passage 44. A valve rod 46 extends through an axial passage 19 in the drive shaft 20 and connects against rod 47 in a throughbore 49 extending through the air motor at the rear end of the tool. Rod 47 is attached to a valve member 48. The valve member 48 is biased by a spring 50 toward the closed position. The rod 46 thus is biased against a valve control rod 52 which is retained within the counterbore 42. The rod 52 includes a large forward diameter end 54 cooperative with and slidably received in passage 56 of the counterbore 42.

A ball or bearing 62 is driven by the forward end 54 of the rod 52 to engage first and second transverse or radially extending roller members 64 and 66 which fit within the transverse passage 44. Bearing 62 forces the roller members 64, 66 radially outward against a first limiting circumferential surface 68 of an annular sleeve 70 slidably mounted on the outside of clutch member 32. The sleeve 70 includes an inclined, inside annular surface 72 which connects with a second limiting surface 74 having a greater diameter than the first limiting surface 68.

The sleeve 70 is normally biased in the forward axial direction toward bit holder 28 by means of a biasing spring 76 which is engaged by an adjustable washer 79 and nut 78 threaded on the outside of the clutch member 32. The adjustable nut 78 also engages a second clutch biasing spring 80 that engages against a roller bearing assembly 82 slidably mounted on the outside of the clutch member 32 and disposed against ball bearings 84. Each ball bearing 84 is received in a separate, compatible axial passage 86 of clutch member 32 and is radially spaced from the axis 16. Thus, four rolling contact bearings 84, e.g. ball bearings, are positioned equally, radially around the axis 16 in passages 86 of member 32.

The ball bearings 84 engage in pockets 88 defined in a circumferential or annular flange surface 90 of the bit holder 28. Surface 90 is transverse to axis 16. The spring 80 biases the ball bearings 84 into the pockets 88 during normal operation of the tool. The entire clutch assembly 32 is also loaded or biased toward bit holder 28 by virtue of engagement of an annular seat member 58 which is spring biased by a spring 60 acting against the forward end of the shaft 20. Seat member 58 fits against a land or flange 61 in counterbore 42.

Operation

Pressurized air enters through the inlet fitting 14 and flows through passage 15 to valve 48. However, entry to the passage 18 to the motor is blocked by the valve 48.

Valve 48 is actuated by engaging the bit 31 of the tool with a fastener, for example. Thus, a bit 31 held in the bit holder 28 is engaged against a fastener to manually force the bit holder 28 as well as the clutch member 32 axially rearward against the force of the spring 60. Note the sleeve 70 will, at this time, be in the position depicted in FIG. 1 with spring 76 maintaining sleeve 70 in position. Similarly balls 62, 64, 66 are retained in position depicted in FIG. 1. Thus, as the clutch member 32 is forced in a rearward direction, it causes balls 64, and 66 to engage the ball 62 against rod member 52 and thereby drive the valve control rod 46 rearwardly against rod 47 to open the valve 48. The rod 52 moves coincidentally with member 32 inasmuch as the sleeve 70, roller members or balls 64 and 66 as well as the ball 62 maintain their relative positions shown in FIG. 1.

Thus, the total resistance to rearward axial motion of the bit holder 28 and clutch member 32 is supplied by the spring 60 within the counterbore 42 and spring 50. This resistance is overcome by manually forcing the bit 31 against the fastener which is to be fastened. Consequently, as previously explained, the valve 48 opens permitting pressurized air to flow to the rotary vane air motor and thus initiate operation of torque output from that motor through the shaft 20 and ultimately to the fastener.

Rotation from shaft 20 is transmitted through the clutch member 32 to the bit holder 28 via the ball bearings 84 in passages 86 which are retained in the pockets 88 by action of the spring 80 acting thereon. The pockets 88 are shaped to be complementary or cooperate with the ball bearings 84. In the figures, the ball bearings 84 are spherical and the pockets 88 are hemispherical in shape. However, the ball bearings 84 and corresponding pockets 88 may be of any prescribed, compatible shape, such as scalloped or scooped, to permit movement of a ball bearing 84 from a pocket 88 to the surface 90 in a ramping fashion. The ball bearings 84 thus may move from pockets 88 to an unlocked position by relative movement in the clockwise rotational sense or to a locking position, for example, by movement of ball bearings 84 on surface 90 in a relative counterclockwise sense. Numerous other configurations of the pockets and bearings are possible. Note that the nut 78 and washer 79 are adjustable to vary the biasing load on the spring 80 thereby providing for adjustment of the torque threshold setting level of the tool.

In review, when the torque resistance on a fastener increases to a threshold, the balls 84 climb out of the depressions 88 onto the surface 90 of the bit holder 28 by continued clockwise movement of clutch member 32 relative to bit holder 28. This causes the clutch member 32 to be rotationally displaced relative to the bit holder 28 thereby terminating torque application to the fastener. The movement of ball bearings 84 from pockets 88 cause axial movement of ball bearings 84 against the thrust bearing or roller bearings assembly 82 and associated race as well as the spring 80 to thereby axially transmit the assembly 82 rearwardly on the outside of the clutch member 32. This simultaneously causes the sleeve 70 to be axially translated rearwardly inasmuch as the sleeve 70 is engaged by the race and thrust bearing assembly 82. The sleeve 70 moves against the biasing force of spring 76 axially and rearwardly thereby releasing engagement of surface 68 against balls 64, 66 and permitting the balls 64 and 66 to move radially outward in passage 44 to the second limiting position defined by the surface 74. When in this position the spring 50 acting on the valve 48 and through rods 49, 46, 52 against bearing 62 drives the rods 49, 46, 52 and 62 axially toward the forward end of the tool. Thereby the valve 48 is caused to close. This terminates pressurized air flow in passage 18 and thus terminates operation of the rotary vane air motor as well as torque output from the shaft 20.

When the motor has ceased operation, then each ball bearing 84 will continue up the ramp of depression 88 and roll over the top of the surface 90 into the next depression 88 or, alternatively, will roll back into the depression 88. In either event, this causes axial displacement of the thrust bearing 82 due to the force of the associated spring 80. However, the sleeve 70 is maintained in its position with surface 74 holding balls 64, 66 and will not return to its original position shown in FIG. 1 inasmuch as the balls 64 and 66 are maintained in an outward distended position in passage 44. This results because of air pressure on valve 48 and the pressure of the spring 50 all acting on the rods 49, 46, 52 and the fact that the clutch member 32 is maintained in a rearward axial position by manual pressure against a fastener.

To return the sleeve 70 to the position of FIG. 1, the tool must then be manually removed from the fastener against which it was originally impinged. Such removal permits release of axial pressure in the rearward direction on the clutch member 32 and spring 60. By releasing pressure on the clutch member 32, the spring 60 will cause the clutch member 32 and bit holder 28 to slide in the forward axial direction thereby permitting axial translation of the member 32 to the position shown in FIG. 1. The rods 49, 46, 52 will, however, not translate in this instance because their axial travel in the forward direction is complete since the valve 48 is seated. Thus, the spring 60 will cause the clutch member 32 to move forward relative to rod 52 and more particularly relative to end 54 of rod 52. This causes the ball 62 to effectively move into the passage 56 in member 32 which, in turn, releases balls 64, 66 and permits the balls 64, 66 to move inward in the passage 44. This releases balls 64, 66 from engagement with surface 74 and the sleeve 70 will then move forward being biased by spring 76. The device is thereby reset for the next fastening operation. The operation can then be again performed on the next fastener inasmuch as the described operation set forth provides for one cycle of operation.

Various changes can be made to the structure of the invention while remaining within the spirit thereof. For example, the construction of the sleeve 70, the balls 84, the balls 64, the rod 52 and various other component parts of the control device may be altered without changing the spirit and scope of the invention. The invention is therefore to be limited only by the following claims and their equivalents.

What is claimed is:

1. In a fluid powered tool of the type including a housing with a forward end, and intermediate section and a rear end, a fluid driven motor in the housing with a rotary output shaft defining an axis of rotation, a fluid inlet to the motor, a valve member cooperative with the fluid inlet to control fluid flow to the motor, a bit holder for a tool bit at the forward end of the tool and a clutch mechanism intermediate section and connecting the output shaft with the bit holder, the output shaft, bit holder and clutch mechanism being substantially coaxial, the improvement comprising, in combination:

a torque responsive, fluid flow start, shut-off and reset mechanism incorporated in the clutch mechanism, said torque responsive mechanism including:

(a) means for support of the bit holder in the housing to permit both rotary and axial movement;

(b) a driving clutch member keyed at one end to the output shaft for simultaneous rotation with the output shaft and attached at its opposite end to the bit holder to permit simultaneous axial movement with the bit holder and independent rotary movement relative to the bit holder;

(c) clutch engaging means for mechanically connecting the driving clutch member to the bit holder for simultaneous rotary movement, said means including at least one biased roller member intermediate the clutch member and the bit holder, said roller member radially spaced from the axis of rotation and axially movable with respect to one of the driving clutch member and bit holder, said roller member biased by roller member biasing means into a receiving pocket of the other of the driving clutch member and bit holder during rotary driving operation of the tool below a torque threshold, said roller member axially translatable from said receiving pocket during driving operation of the tool above said torque threshold whereby the bit holder and driving clutch member rotationally disengage;

(d) an axial counterbore in the driving clutch member extending from the motor output shaft;

(e) a valve control rod in the counterbore having a forward end and mechanically connected at the other end to the valve member;

(f) valve control rod biasing means for axially biasing the valve member and the valve control rod toward a valve member closed position;

(g) driving clutch member biasing means in the axial counterbore of the driving clutch member for biasing the driving clutch member axially toward the forward end relative to the output shaft;

(h) a radial passage in the driving clutch member intersecting the counterbore;

(i) a radially displaceable member in the radial passage cooperative with the forward end of the valve control rod;

(j) an axially displaceable sleeve over the driving clutch member radial passage, said disposable sleeve having first and second radial limiting means both cooperative with the radially displaceable member to control the position of said radially displaceable member in the radial passage to thereby control the axial position of the valve control rod in the counterbore; and (k) sleeve biasing means for normally biasing the sleeve to a first radial limiting position corresponding to engagement with the first radial limiting means wherein the valve control rod is extended axially toward a valve open position;

whereby to start the motor by opening the valve member the bit holder is axially translated rearwardly against the force of the value control and biasing means and the driving clutch member biasing means as the driving clutch member and bit holder are rotationally engaged, and the sleeve is in the first limiting position to hold the valve control rod in the rearward position and cause the valve member to open;

whereby to control torque the rotatably connected driving clutch member and bit holder are disengaged when the torque threshold is exceeded and the roller member is axially translated rearwardly against the force of the ball members biasing means to simultaneously translate the sleeve to the second limiting position thereby permitting the radially displaceable member to move radially outward in the passage and release the control rod for movement toward the forward end and close the valve member to terminate operation of the motor; and whereby to reset the mechanism, release of axial force on the bit holder permits the bit holder and shaft to move axially forward in response to drive clutch member biasing means and the sleeve biasing means to effect subsequent radial movement of the radially displaceable member to the first limiting position.

2. The improvement of claim 1 wherein the bit holder includes a transverse flange with the pocket defined therein and the clutch member includes an axial bore for receipt of the roller member.

3. The improvement of claim 2 wherein the sleeve is axially driven by the roller member in the rearward end direction and by sleeve biasing means in the forward end direction.

4. The improvement of claim 3 wherein the sleeve biasing means and the roller biasing means comprise coaxial spiral spring members fitted over the driving clutch member.

5. The improvement of claim 2 wherein the roller member biasing means is adjustable.

6. The improvement of claim 1 wherein the means for biasing the roller member is adjustable.

* * * * *